US006101802A

United States Patent [19]

Erdmann

[11] Patent Number: 6,101,802

[45] Date of Patent: Aug. 15, 2000

[54] TAKE-UP UNIT FOR TAKE-UP OF A SYNTHETIC FILAMENT YARN ONTO A COP

[76] Inventor: Wolfgang Erdmann, Waldstrasse 10, 40883 Ratingen, Germany

[21] Appl. No.: 09/371,271

[22] Filed: Aug. 10, 1999

[30] Foreign Application Priority Data

Aug. 13, 1998 [DE] Germany ..... 198 36 645
Aug. 20, 1998 [DE] Germany ..... 198 37 746

[51] Int. Cl.[7] ..... D01H 7/52

[52] U.S. Cl. ..... 57/75; 57/124; 57/156; 57/119; 57/125

[58] Field of Search ..... 57/122, 124, 136, 57/125, 119

[56] References Cited

U.S. PATENT DOCUMENTS

| | | | |
|---|---|---|---|
| 3,258,904 | 7/1966 | Winterbottom et al. . | |
| 4,023,342 | 5/1977 | Schenkel | 57/156 |
| 4,270,340 | 6/1981 | Baucom et al. | 57/75 |
| 5,009,063 | 4/1991 | Yamaguchi et al. | 57/124 |

FOREIGN PATENT DOCUMENTS

| | | |
|---|---|---|
| 1 560 229 | 11/1971 | Germany . |
| 28 52 396 | 9/1979 | Germany . |
| 31 44 887 | 4/1993 | Germany . |
| 44 14 042 | 10/1995 | Germany . |
| 196 07 790 | 9/1997 | Germany . |

*Primary Examiner*—John J. Calvert
*Assistant Examiner*—Mary K. Fiore
*Attorney, Agent, or Firm*—Nixon Peabody LLP; David S. Safran

[57] ABSTRACT

A take-up unit for take-up of a synthetic filament yarn (1) onto a cop (2), with a rotary drive (3) which carries the cop (2) and which causes the cop (2) to rotate at a speed which can be stipulated, with a balloon thread guide (5) which is located in the axial direction at a considerable distance from the cop (2), with a ring holder (6) which surrounds the cop (2) at a constant radial distance with a race located therein and a ring traveler which runs on the race, with a ring holder drive (9) which carries the ring holder (6) and which moves the ring holder (6) back and forth parallel to the longitudinal axis of the cop (2) between the ends of the latter, take-up of the filament yarn (1) onto the cop (2) taking place according to stipulated cop generation factors and such that the cop (2), at the conclusion of take-up, has a roughly cylindrical middle area of large diameter and end areas with diameters which decrease towards the ends of the cop (2) except for the raw diameter of the latter. The ring traveler on the ring holder (6) can be actively braked by means of a braking means when the rise areas are passed, at least once a predetermined diameter of the middle area has been attained. In this way, overdelivery of the filament yarn (1) in the end areas of the cop (2) can be reliably prevented even at large diameters of the cop (2) or large diameter differenes.

16 Claims, 3 Drawing Sheets

TAKE-UP UNIT FOR TAKE-UP OF A SYNTHETIC FILAMENT YARN ONTO A COP

BACKGROUND OF THE INVENTION

1. Field of the Invention

The invention relates to a take-up unit for taking up a synthetic filament yarn onto a cop of the type which has a rotary drive which carries the cop and which causes the cop to rotate at a speed which can be set, with a balloon thread guide which is located in the axial direction at a considerable distance from the cop, with a ring holder which surrounds the cop at a constant radial distance with the race located therein and a ring traveler which runs on the race, with a ring holder drive which carries the ring holder and which moves the ring holder back and forth parallel to the longitudinal axis of the cop between the ends of the cop, take-up of the filament yarn onto the cop taking place according to predetermined cop generation factors and such that the cop, at the conclusion of take-up, has a roughly cylindrical middle area of large diameter and end areas of diameters which decrease towards the end of the cop except for the raw diameter of the cop.

2. Description of related Art

Take-up units of the type under consideration are generally parts of ring spinning frames or ring doubling frames. As the thread carrier, the cop has a smooth, slender sleeve of small diameter and is wound with the filament yarn with turns which are essentially parallel, in contrast to cross-wound bobbins which are wound with crossing turns. A cop wound with synthetic filament yarn has a roughly cylindrical middle area of large diameter, and on the ends which adjoin areas on which the yarn has been wound on, the diameter decreases towards the end of the cop as far as the raw diameter of the thread carrier.

The synthetic yarn is delivered by a pretreatment section of the take-up unit system with a certain delivery speed of, for example, 1000 to 1200 m/min. The cop rotates with a speed which can be changed by the control, but which is essentially constant, for example, a speed of roughly 11000 rpm. This corresponds in the not yet wound thread carrier of the cop to a certain peripheral speed of, for example, 1700 rpm. The difference of the speeds is accommodated by a ring traveler which is entrained by the filament yarn wound onto the cop. This ring traveler rotates on a race of the ring holder which surrounds the cop with a constant radial spacing. In this example, the ring traveler would have a peripheral speed of roughly 700 rpm, according to the difference of the peripheral speed of the thread carrier and the delivery speed of the filament yarn. Due to the much greater diameter of the track of the ring traveler relative to the outside surface of the thread carrier of the cop the ring traveler in a sample case has a speed of only roughly 1500 rpm.

As explained above, the ring traveler is entrained by the filament yarn wound onto the cop; factors oppose this entrainment which try to brake the ring traveler on the race. For example, there is the friction of the ring traveler on the race, and also there is the air resistance of the filament yarn between the balloon thread guide and the ring traveler which is especially high. The filament yarn in this area also rotates with the speed of the ring traveler, inflates into a so-called "balloon", and of course, it has considerable air resistance.

It is apparent from the above explanation that the difference of speed between the thread carrier of the cop, on the one hand, and the ring traveler, on the other, determines the take-up speed for the filament yarn on the thread carrier of the cop. The motion of the ring traveler on determines the circumference in which the filament yarn is twisted. If there were no difference of speed, the filament yarn would only be twisted, but not taken up, and the ring traveler would not move, the delivery speed for the filament yarn, aside from stretching, would have to be equal to the take-up speed of the cop. Between these two extremes is the working range of the take-up unit.

Several take-up units of the type under consideration are often combined into a so-called ring rail (published German Patent Application DE-A-196 07 790). The invention proceeds from this prior art.

The ratio of the rpm and peripheral speed of the cop depends on the diameter present at the time. With increasing take-up of the filament yarn, in the cylindrical middle area, there is an increasing diameter, while in the end areas, the slope of the winding-on becomes greater and greater. If an unchanged rpm of the cop is assumed, a greater diameter of the wound yarn means that the periphral speed increases. However, since the delivery speed of the filament yarn from the pretreatment section does not increase, the speed of the ring traveler must increase accordingly.

The ring traveler is moved back and forth by the ring holder drive between the ends of the cop in order to wind onto the cop uniformly. In the end areas, where the diameter of the wound-on yarn decreases toward the ends of the cop, the peripheral speed of the cop decreases dramatically towards the ends, just because the diameter decreases towards the ends. The traveler speed first the same, in any case follows the decrease of the peripheral speed of the cop only with a delay. This engenders the danger of a strong reduction of the tensile force of winding, to a certain extent "over-delivery" of the filament yarn. This can lead to winding faults in the end areas. Here, the type of winding onto the cop is important.

There are different kinds of winding, specifically flyer, cop, compound and combination winding. In flyer winding, the ring holder drive is moved back and forth with an amplitude which decreases in the course of continuing winding onto the cop, the winding therefore always takes place in the cylindrical section of the respective layer. The above explained problem of "over-delivery" in the end areas does not occur. But, flyer winding is very susceptible to dirt and damage since the complete cop is affected when a problem occurs in only a small area.

In compound winding and cop winding the situation is somewhat different. A cop which has been wound using the combination method the least sensitive. Here, the amplitude with which the ring holder drive is moved back and forth changes periodically between the full winding length of the cop and the winding length of the cylindrical middle area.

Especially in combination winding of the cop, does the above explained problem of reduction of winding tensile force arise. It is the more noticeable, the greater the difference between the diameter of the middle area of the completely wound cop and the raw diameter of the cop. Finally, for a long time this problem has limited the maximum attainable cop diameter and the cop weight.

For purposes of controlling the movement of the ring holder by the ring holder drive, especially for fixing the reversal points of the ring holder motion, fixed operating points for the ring holder drive are usually stipulated. The prior art (the previously mentioned published German Patent Application DE-A-196 07 790) discloses continually scanning the current diameter of the cop in the different areas, especially by proximity optical scanning. However, in many cases, this control engineering effort is not acceptable.

SUMMARY OF THE INVENTION

The primary object of the present invention is to avoid faults in winding yarn onto a cop which are caused by the dramatic reduction of the winding tensile force in the end areas of the cop, and also with greater differences between the diameter of the middle area of the completely wound cop and the raw diameter of the cop.

The aforementioned object is achieved in a take-up unit of the initially mentioned type by the ring traveler on the ring holder being actively braked by means of a braking means and by this braking taking place every time, or after a certain minimum diameter of the middle area of the wound cop is exceeded, when the end areas of decreasing diameter are passed, while the rotary drive continues to run unchanged.

It has been recognized in the invention that faults can be avoided in winding onto the cop in the rise areas when the take-up speed of the filament yarn is kept as constant as possible, even when the diameter of the cop changes. This could be done in principle by increasing the rpm of the cop in the end areas towards the end, or by decreasing it in the middle area. This acceleration or deceleration of the cop could be controlled in general, according to the inputs of the control of the ring holder drive. But here, the problem is that the quite considerable amount of this acceleration requires use of much more efficient electric drive motors, that the continuing acceleration and deceleration of the cop which becomes heavier and heavier with increasing winding-on of the yard are associated with considerable power consumption and that, of course, the rpm of the cop cannot be increased without limit.

Therefore, in accordance with the invention the ring traveler, during operation with a rotary drive which continues to run unchanged, is actively braked by the braking means, via air resistance of the filament yarn and by friction, while the filament yarn is taken up onto the cop in the rise areas. This active braking counteracts the inertia of the ring traveler, which slows down accordingly more quickly, and therefore, follows the slowing down of the peripheral speed of the cop towards the end almost without delay. Overdelivery of the filament yarn is reliably prevented.

Braking can be performed merely in an on-off manner, therefore engaged or disengaged, starting at a certain operating point. Rising or falling control or even full-value control is more complex. Otherwise, it is especially practical, in terms of control engineering, to activate the braking means only starting at a certain minimum diameter of the middle area of the wound cop so that the braking means is not activated at all during initial winding onto the cop. This of course saves a large amount of energy.

Preferred embodiments and developments of the take-up unit in accordance with the invention for taking up a synthetic filament yarn onto a cop are described below. From the current standpoint, the configuration of the braking means is of special importance such that the braking action on the ring traveler is accomplished pneumatically. This type of braking of the ring traveler has proven especially useful being free of wear and faults, and very easy to control These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

As has already been explained in the general part of the specification, a take-up unit of the type under consideration is intended and suited for taking up a synthetic filament yarn 1 on a cop 2, for example, in a ring spinning frame or ring doubling frame. The filament yarn 1 has already been mechanically treated in a pretreatment section (not shown), for example, has been subjected to stretching. The yarn 1 enters the take-up unit with a certain delivery speed, in this embodiment, for example, with a delivery speed of roughly 1000 m/min and is wound onto the cop 2, while being twisted at the same time.

Figure 1:
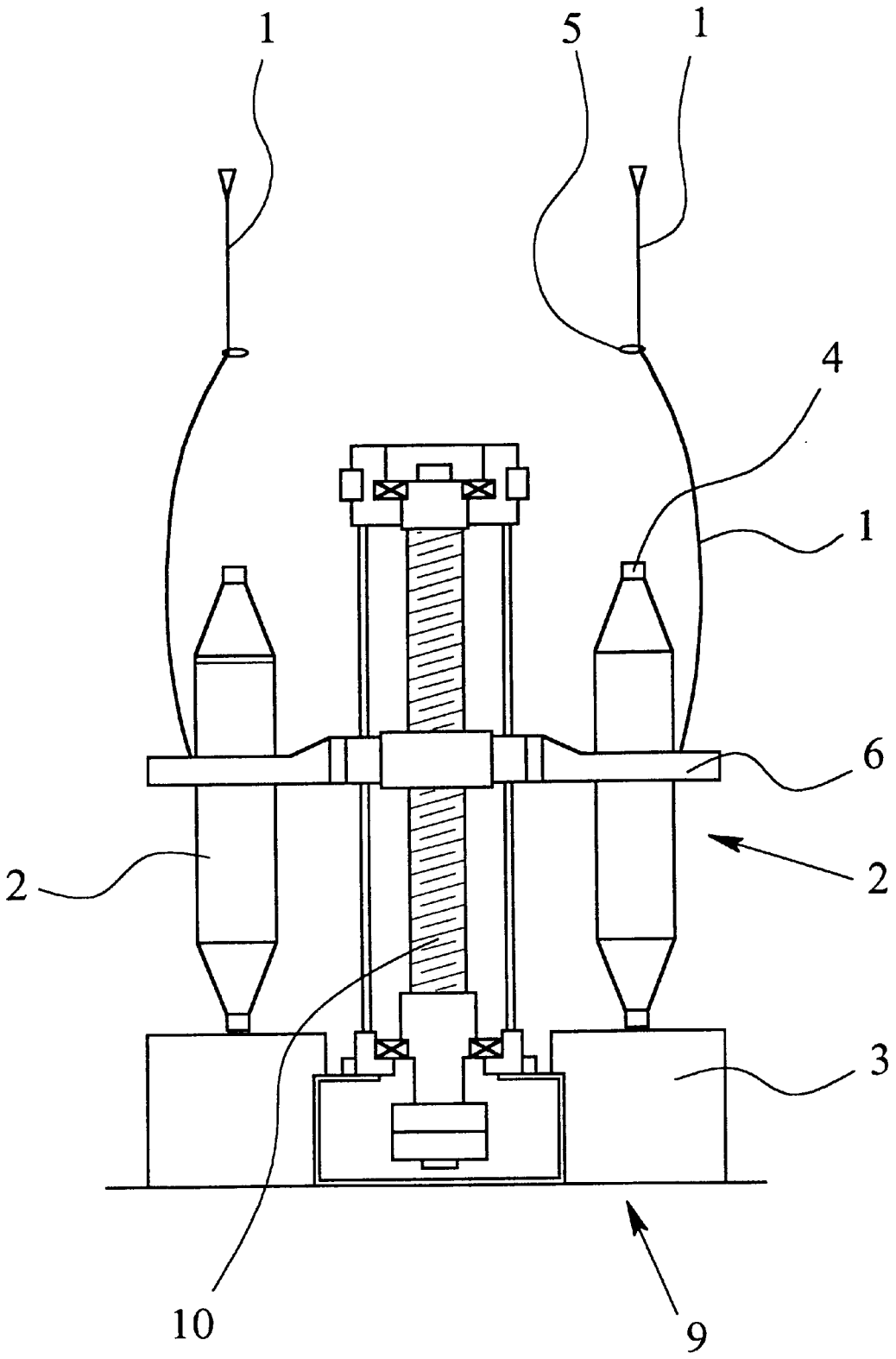
FIG. 1 is a schematic of a take-up unit of a ring spinning frame or ring doubling frame, here integrated in the form of a ring rail.

The example shown in FIG. 1 shows two take-up units which are located next to one another and which are located within a so-called ring rail which comprises, overall, a plurality of these take-up units. Each take-up unit has, first of all, a rotary drive 3 which carries the cop 2 and which causes the cop 2 to rotate at a speed which can be preset. Currently, speeds up to a maximum 14000 rpm can be utilized. A speed of the cop 2 of roughly 11000 rpm is realistic, this speed of the cop 2 being regulated according to cop generating factors to be stipulated by machine control over the entire reeling time, therefore, until winding of the cop 2 with the filament yarn 1 is completed.

It has already been explained in the "Background" part of the specification that with a typical diameter of a thread carrier 4, and therefore, of the inner smooth sleeve of the cop 2, a speed of roughly 11000 rpm corresponds to a peripheral speed of, for example, roughly 1700 m/min.

The filament yarn 1 is delivered to the cop 2 by a balloon thread guide 5 which is located in at a considerable distance from the cop 2 in the axial direction, and for a vertically oriented cop 2, above the cop. The "balloon" is the envelope of the path of motion which is widened in the manner of a balloon during rotation by the centrifugal force and which the filament yarn 1 has traversed.

The rotary drive 3 for the cop 2 can be its own electric-motor operating drive, or it can also be only a coupling to a centrally arranged drive.

Figure 2:
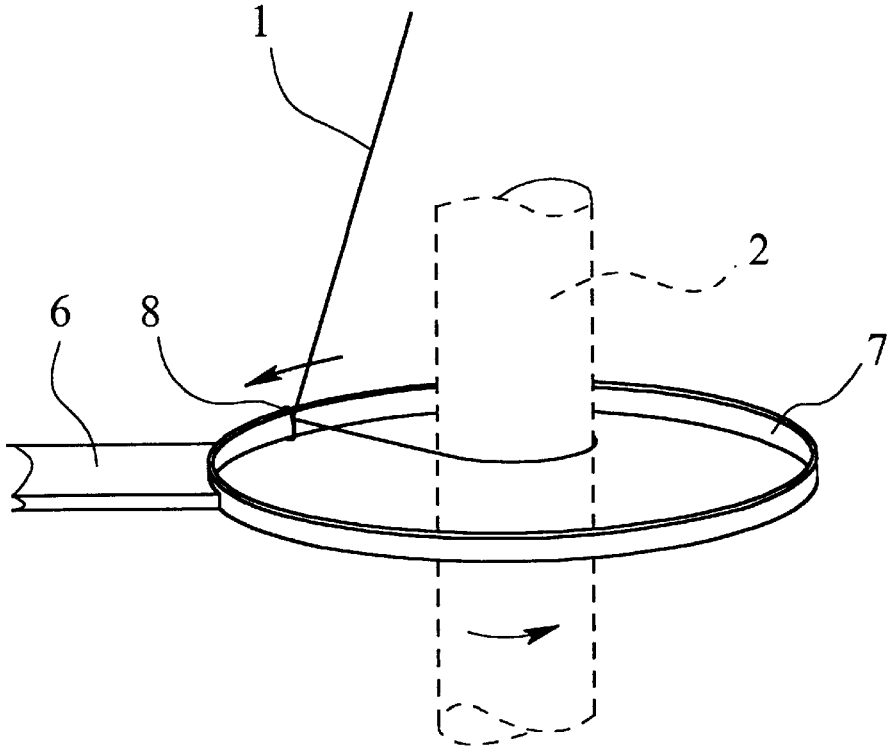
FIG. 2 shows the area of the ring holder of the take-up unit from FIG. 1 in schematic form.
Figure 3:
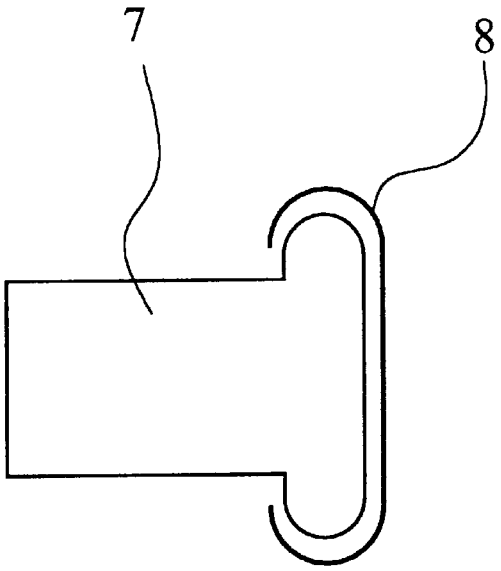
FIG. 3 schematically shows, in section, the race with the ring traveler from FIG. 2.

A ring holder 6 surrounds the cop 2 at a constant radial distance, with a race 7 which is located therein and a ring traveler 8 which runs on the race 7 (FIG. 2 and FIG. 3 show this more clearly). FIG. 1 shows simply the ring holder 6 which the filament yarn 1 enters from the top on the inside. The ring holder 6 is carried by a ring holder drive 9 which moves the ring holder 6 back and forth parallel to the longitudinal axis of the cop 2 between its ends. In this embodiment, this is motion is up and down, but in principle, it would also be possible to use a motion oriented differently in space.

In this embodiment, the ring holder drive 9 has at least one threaded spindle 10 with which the ring holder 6 can be moved up and down accordingly. In particular, reference can be made to previously mentioned published German Patent Application DE-A-196 07 790 for an example of this drive engineering which, by itself, is not a novel aspect of the invention.

FIG. 1 shows the form of the wound-on filament yarn 1 which is typical for a cop 2 and which is determined by the yarn being taken up essentially parallel, not crosswise as in a cross-wound bobbin. This necessitates the end areas 2A of the cop 2 without which yarn wound onto the cop 2 would not be stable. The filament yarn 1 is taken up onto the cop 2 according to predetermined cop generation factors and such that the cop 2, once the yarn 1 is completely wound on to it, has a roughly cylindrical middle area of large diameter and end areas 2A with diameters which decrease towards the ends of the cop 2, except for the raw diameter of the cop, i.e, the diameter of the thread carrier 4 the ends of which are exposed.

It has already been explained in the "Background" part of the specification in what way the ring traveler 8 adapts the high peripheral speed of the cop 2 to the delivery speed of the filament yarn 1. In the sample case addressed above, the ring traveler 8 is entrained on the race 7 by the filament yarn 1 so that it has a peripheral speed of roughly 700 m/min, which represents the difference of the peripheral speed of the thread carrier 4 at 1700 rpm relative to the delivery speed at roughly 1000 m/min. The speed of the ring traveler 8 adapts itself to the changing peripheral speed of the cop 2 with opposing actions, on the one hand, of the friction of the ring traveler 8 on the race 7 and the air resistance of the filament yarn 1 in the "balloon" and on the other hand, of the thread tensile force exerted on the filament yarn 1 by the rotating cop 2. The associated time constant is relatively great and this leads to the initially explained problems in the transition from the cylindrical middle area into the end areas 2A.

FIGS 2 and 3 show the typical form of a C-shaped ring traveler 8 on the metallic race 7, the direction of rotation be labeled with arrows in FIG. 2. In FIG. 2, only the middle area of the cop 2 is shown in phantom outline.

The problem of faults in winding onto the cop 2 which was addressed above and which is especially relevant in certain types of winding-on due to the dramatic reduction of the winding tensile force on the filament yarn 1 in the transition to he end areas 2A, as a result of the (still) too high speed of the race 7, becomes more serious, the greater the diameter of the cylindrical middle area of the cop 2 and the steeper the slope of the end areas 2A becomes or is. At a predetermined cop speed, the attainable total diameter and ultimately also the total weight of the cop 2 are limited thereby.

The teaching of this invention helps with this problem by the fact that the ring traveler 8 can be actively braked on the race 6 by a braking means 11 (FIG. 4) and that this braking takes place when the areas 2A are passed, at least once a predetermined diameter of the middle area has been attained.

Braking and acceleration of the ring traveler 8 is much less energy-intensive than braking and acceleration of the cop 2 itself; this would be a possible alternative. With the rotary drive 3 for the cop 2, a motorized drive which is controlled anyway is available; the cost to be borne for corresponding acceleration or deceleration of the cop 2 in the rise areas would however be much greater than the cost associated with implementation of an additional braking means 11 for the ring traveler 8, to say nothing of the continuing operating costs.

For the braking of the ring traveler 8, which is present anyway due to friction and the air resistance of the filament yarn 1, which is the basic prerequisite for operation of the take-up unit overall according to the invention, the is therefore also an additional, active, selectively engaged braking of the ring traveler 8 in order to ensure that the ring traveler 8 follows the drop of the peripheral speed of the cop 2 with a short time delay, so that the overdelivery of the filament yarn 1 which has been occurring for a long time is reliably prevented in this phase of operation of the take-up unit.

The preferred embodiment shown accomplishes active braking of the ring traveler on the race 7, that is, braking which can be engaged and disengaged by engaging and disengaging the braking means 11, therefore only two operating states of the braking means 11. This can be done very easily by design and in many cases adequately. The braking means 11 is controlled via the above explained operating points on the ring holder drive 9 or, if present, via the explained scanning means. In this case, the control mechanisms which are necessary anyway for the rotary drive 3 of the cop 2 and the ring holder drive 9 can be used, for example, to correctly set the traversing length of the ring holder drive 9. As an alternative to engagement and disengagement, there is of course also rising or falling control or full-value control, but the latter is relatively complex and not always necessary.

It has been explained above that the braking means 11 is active mainly in the rise areas towards the ends of the cop 2 and additionally brakes the ring traveler 8. Optimization is associated with control of the braking means 11 such that it is activated only beginning with a certain minimum diameter of the middle area of the wound cop 2. This measures takes into account the fact that the above explained problem of overdelivery of the filament yarn 1 become quantitatively relevant only starting with a certain minimum diameter of the cop 2 in the middle area. Previously the "natural" braking effects on the ring traveler 8 had been sufficient. The rise angle of the rise area is not yet so large that the time constant of the ring traveler 8 is a problem. Only starting with a certain minimum diameter does the problem become noticeable, starting only there must active braking of the ring traveler 8 take place upon entering the rise areas of the cylindrical middle area by engaging the additional braking means 11.

There are various possibilities in accordance with the invention for implementing the braking means 11 provided for the ring traveler 9. First of all, the braking action on the ring traveler 8 can be mechanically generated by friction by means of the braking means 11. For example, the race 7 can mechanically widened to accomplish additional braking action by friction on the ring traveler 8.

Figure 4:
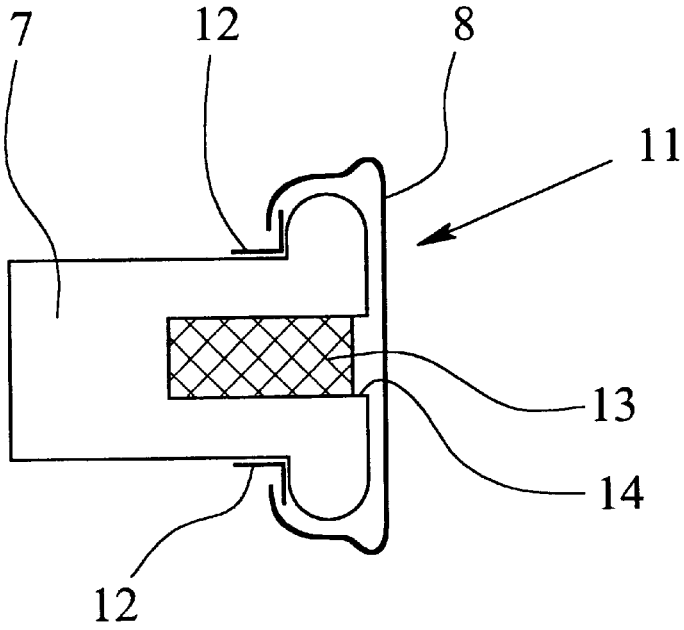
FIG. 4 shows a preferred embodiment of a modified race with a ring traveler for building the braking means.

One alternative is to produce the braking action on the ring traveler 8 electromagnetically by the braking means 11. FIG. 4 shows one schematic example thereof; it will be explained below.

Furthermore, the braking action on the ring traveler 8 can be produced hydraulically by the braking means 11, or also pneumatically.

It is always necessary to distinguish between the force which the braking of the ring traveler 8 engenders, on the one hand, and the cause of this force on the other. The power source can of course be any type, therefore mechanical electromagnetic, hydraulic or pneumatic power sources without the need for further explanation here.

FIG. 4 shows for electromagnetic accomplishment of the braking action that the race 7 and the ring traveler 8 are made of magnetically active, especially ferromagnetic, material and they are separated from one another by a spacing layer 12 of magnetically passive material, and that the race 7 is provided with an electrically triggerable exciter winding 13. The spacing layer 12 can be assigned to the race 7 or to the ring traveler 8; two spacing layers 12 can also interact with one another. In this preferred embodiment, it is provided that the race 7 has a radially open peripheral groove 14 in which the exciter winding 13 is located.

The embodiment shown in FIG. 4 illustrates a configuration in which the braking action itself is finally again mechanical braking action. But, electromagnetic braking can be accomplished by generating eddy current in a corresponding component.

For hydraulic braking action, for example, the ring traveler 8 can be allowed to run partially in a liquid bath which can be influenced by the braking means 11, and for example, the viscosity of the liquid can be changed instantaneously by electrical triggering.

Figure 5:
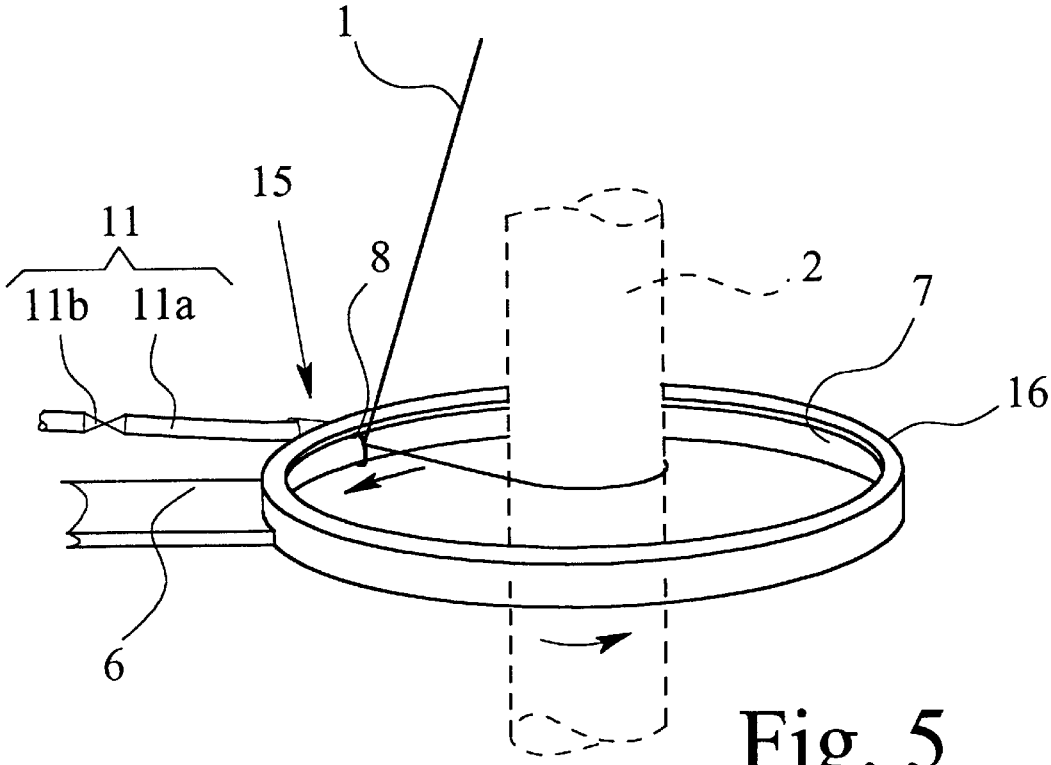
FIG. 5 is a view corresponding to that of FIG. 2, but showing another preferred embodiment of a take-up unit in accordance with the invention.

FIG. 5 shows one especially preferred embodiment of a braking means 11 of a take-up unit in accordance with the invention for taking up a synthetic filament yarn 1. Here, pneumatic braking of the ring traveler 8 is produced by an air nozzle 15 which is pointed at the race 7 opposite to the direction in which the ring traveler 8 runs and which is located on the ring holder 6. By means of the braking means 11, a compressed air flow from the air nozzle 15 can be directed against the ring traveler 8. This air nozzle 15 is only partially visible in the embodiment shown in FIG. 5, but a compressed air hose 11*a* and a switching valve 11*b* which supply air to the nozzle can be recognized.

In a free arrangement with an open race 7, similar to FIG. 2, it is especially feasible that there are a plurality of corresponding air nozzles 15 distributed around the periphery of the race 7. However, FIG. 5 shows an alternative which is characterized in that an annular channel 16 partially surrounds the race 7, the air nozzle 15 discharging into the annular channel 16. In this case as well, several air nozzles 15 could be provided spaced around the periphery; but here, in the embodiment shown, one air nozzle 15 has been considered sufficient. The compressed air flow routed into the annular channel 16 in this way flows around the race 7 on a section such that very effective, contactless, additional braking of the ring traveler 8 takes place, as desired. The embodiment shown indicates that the annular channel 16 partially surrounds the race 7 from the back and overhead. The annular channel 16 can envelop the race 7 to a substantial extent, but the area of the race 7 in which the filament yarn 1 rotates at high speed and is deflected by the ring traveler 8 must be kept clear.

The result is perfect winding quality of the cop 2 even at the very large diameters of the completely wound cop 2, with the correspondingly steep rise areas, which have long been considered to be unattainable.

While various embodiments in accordance with the present invention have been shown and described, it is understood that the invention is not limited thereto and is susceptible to numerous changes and modifications as known to those skilled in the art. Therefore, this invention is not limited to the details shown and described herein, and includes all such changes and modifications as are encompassed by the scope of the appended claims.

What is claimed is:

1. A take-up unit for take-up of a synthetic filament yarn onto a cop comprising:

a rotary drive for carrying the cop and causing the cop to rotate at a set speed;

a balloon thread guide located at a distance from the cop in an axial direction;

a ring holder surrounding the cop at a constant radial distance with a race located therein;

a ring traveler which runs on the race;

a ring holder drive for carrying the ring holder and moving the ring holder back and forth parallel to a longitudinal axis of the cop between ends of the cop, take-up of the filament yarn onto the cop taking place according to stipulated cop generation factors and such that the cop, at the conclusion of take-up, has roughly cylindrical middle area of large diameter and end areas with diameters which decrease towards the ends of the cop; and braking means for actively braking the ring traveler on the ring holder, at least once a certain minimum diameter of the middle area of the wound cop is exceeded, when the end areas are passed, while the rotary drive continues to run unchanged.

2. The take-up unit as claimed in claim 1, wherein the braking comprises means for functioning in an on/off manner, is an on/off type braking means.

3. The take-up unit as claimed in claim 1, wherein the braking means comprises a mechanical friction braking arrangement.

4. The take-up unit as claimed in claim 1, wherein the braking means comprises a electromagnetic braking arrangement.

5. The take-up unit as claimed in claim 1, wherein the braking means comprises a hydraulic braking arrangement.

6. The take-up unit as claimed in claim 1, wherein the braking means comprises a pneumatic braking arrangement.

7. The take-up unit as claimed in claim 3, wherein the mechanical friction braking arrangement comprises means for changing dimensions of the race for adjusting friction between the ring traveler and the race.

8. The take-up unit as claimed in claim 4, wherein the electromagnetic braking arrangement comprises the ring traveler and the race being made of a magnetically active material and being separated from one another by a spacing layer of magnetically passive material, and an electrically triggerable exciter winding.

9. Take-up unit as claimed in claim 8, wherein the race has a radially open peripheral groove in which the exciter winding is located.

10. The take-up unit as claimed in claim 5, wherein the hydraulic braking arrangement comprises a liquid bath in which the ring traveler partially runs, the liquid bath containing a liquid having an electrically variable viscosity.

11. The take-up unit as claimed in claim 6, wherein the pneumatic braking arrangement comprises at least one air nozzle which is pointed at the race in a direction opposite a direction of rotation of the ring traveler on the ring holder and means for directing a flow of compressed air through the air nozzle to against the ring traveler.

12. The take-up unit as claimed in claim 11, wherein said at least one air nozzle comprises a plurality of air nozzles circumferentially distributed around the ring holder.

13. The take-up unit as claimed in claim 12, wherein an annular channel partially surrounds the race and the at least one air nozzle discharges the flow of compressed air into the annular channel.

14. The take-up unit as claimed in claim 11, wherein an annular channel partially surrounds the race and the at least one air nozzle discharges the flow of compressed air into the annular channel.

15. The take-up unit as claimed in claim 1, wherein the braking means is a progressively changing braking force type braking means.

16. The take-up unit as claimed in claim 1, wherein the braking means is activated every time that the end areas are passed.

* * * * *